US009670568B2

(12) United States Patent
Lee et al.

(10) Patent No.: US 9,670,568 B2
(45) Date of Patent: Jun. 6, 2017

(54) METHOD OF PREPARING ALUMINUM MATRIX COMPOSITES AND ALUMINUM MATRIX COMPOSITES PREPARED BY USING THE SAME

(75) Inventors: Jung Moo Lee, Gyeongsangnam-do (KR); Su Hyeon Kim, Gyeongsangnam-do (KR); Suk Bong Kang, Gyeongsangnam-do (KR); Young Hee Cho, Gyeongsangnam-do (KR)

(73) Assignee: KOREA INSTITUTE OF MACHINERY & MATERIALS, Daejeon (KR)

( * ) Notice: Subject to any disclaimer, the term of this patent is extended or adjusted under 35 U.S.C. 154(b) by 764 days.

(21) Appl. No.: 14/004,824

(22) PCT Filed: Mar. 16, 2012

(86) PCT No.: PCT/KR2012/001894

§ 371 (c)(1), (2), (4) Date: Sep. 12, 2013

(87) PCT Pub. No.: WO2012/128506

PCT Pub. Date: Sep. 27, 2012

(65) Prior Publication Data

US 2014/0037494 A1 Feb. 6, 2014

(30) Foreign Application Priority Data

Mar. 18, 2011 (KR) ..... 10-2011-0024151
Mar. 28, 2011 (KR) ..... 10-2011-0027821
Sep. 9, 2011 (KR) ..... 10-2011-0092162

(51) Int. Cl.
*B22D 21/04* (2006.01)
*C22C 32/00* (2006.01)
(Continued)

(52) U.S. Cl.
CPC ..... *C22C 32/00* (2013.01); *B22D 19/14* (2013.01); *B22D 21/04* (2013.01); *C22C 1/03* (2013.01);
(Continued)

(58) Field of Classification Search
CPC .... B22D 21/04; B22D 19/14; C22C 32/0036; C22C 32/00
(Continued)

(56) References Cited

U.S. PATENT DOCUMENTS 3,985,557 A * 10/1976 Sanders ..... C22C 1/1036 148/437
6,406,516 B1 * 6/2002 Song ..... C22C 1/058 420/590

FOREIGN PATENT DOCUMENTS

JP 10-158764 A 6/1998
JP 11-043729 A 2/1999
(Continued)

OTHER PUBLICATIONS

Properties of Pure Metals, Properties and Selection: Nonferrous Alloys and Special-Purpose Materials, vol. 2, ASM Handbook, ASM Interantional, 1990, p. 1099-1201.*
(Continued)

*Primary Examiner* — Roy King
*Assistant Examiner* — Janelle Morillo
(74) *Attorney, Agent, or Firm* — Ladas & Parry LLP

(57) ABSTRACT

A method of stably preparing an aluminum composite with excellent mechanical properties while the temperature of molten aluminum is maintained at 950° C. or less, includes mixing aluminum powder, a source material for titanium, a source material for a nonmetallic element that is able to be combined with titanium to form a compound, and an active
(Continued)

material to prepare a precursor; adding the precursor to molten aluminum; and casting the molten aluminum.

15 Claims, 16 Drawing Sheets

(51) Int. Cl.

| | |
|---|---|
| ***B22D 19/14*** | (2006.01) |
| ***C22C 1/03*** | (2006.01) |
| ***C22C 29/00*** | (2006.01) |
| ***C22C 29/12*** | (2006.01) |
| ***C22C 21/00*** | (2006.01) |
| ***C22C 21/02*** | (2006.01) |
| ***C22C 21/06*** | (2006.01) |

(52) U.S. Cl.
CPC ..... *C22C 21/00* (2013.01); *C22C 21/02* (2013.01); *C22C 21/06* (2013.01); *C22C 29/005* (2013.01); *C22C 29/12* (2013.01)

(58) Field of Classification Search
USPC ..... 164/57.1
See application file for complete search history.

(56) References Cited

FOREIGN PATENT DOCUMENTS

| | | | |
|---|---|---|---|
| JP | 2008-260023 | A | 10/2008 |
| KR | 1020020071286 | A | 9/2002 |
| KR | 1020120106201 | A | 9/2012 |

OTHER PUBLICATIONS

J. D. Destefani, Introduction to Titanium and Titanium Alloys, Properties and Selection: Nonferrous Alloys and Special-Purpose Materials, vol. 2, ASM Handbook, ASM Interantional, 1990, p. 586-591.*

International Search Report mailed Sep. 19, 2012; PCT/KR2012/001894.

* cited by examiner

METHOD OF PREPARING ALUMINUM MATRIX COMPOSITES AND ALUMINUM MATRIX COMPOSITES PREPARED BY USING THE SAME

TECHNICAL FIELD

One or more embodiments of the present invention relate to a method of preparing an aluminum matrix composite of which mechanical properties are improved due to the distribution of a nonmetallic material, such as ceramic, as a reinforcing material (or reinforcing phase) in an aluminum matrix and an aluminum matrix composite prepared by using the method.

BACKGROUND ART

In aluminum matrix composites, a nonmetallic material, such as ceramic, which is a reinforcing material, is distributed in a matrix formed of pure aluminum or aluminum alloy. Aluminum matrix composites are light-weight, have high strength and rigidity, excellent wear-resistance, and excellent high-temperature characteristics. Due to such characteristics, aluminum matrix composites are expected for use as a structural material for transportation equipment, a material for the mechanical industry, or an electric and electronic material. Mechanical properties of metal matrix composites are heavily dependent upon the kind, size, shape, volume fraction of a reinforcing material to be added, and interface characteristics of a matrix and the reinforcing material. When a ceramic reinforcing material is added into a matrix metal in a liquid phase to prepare a composite material, due to low wetting properties between the ceramic reinforcing material and the matrix metal, it is difficult to provide the ceramic reinforcing material into a molten metal and also, an unwanted interface reaction may occur at the interface between the matrix metal and the reinforcing material to result in a low interface binding force between the matrix metal and the reinforcing material, thereby leading to a decrease in mechanical characteristics of the composite material. To overcome such problems, recently, research into a process, in which a reinforcing phase spontaneously forms inside molten metal, is actively carried out. A reinforcing phase that spontaneously generates in molten metal is thermodynamically stable, and the interface between the reinforcing phase and a matrix is smooth and thus, the interface binding force between the matrix and the reinforcing phase is strong. Accordingly, mechanical properties of a metal matrix composite prepared by using a spontaneous reaction has better mechanical properties than a composite prepared by using a process including supplying a reinforcing material from the outside.

For use as a reinforcing material, titanium carbide (TiC), titanium boride ($TiB_2$), alumina ($Al_2O_3$), or the like may be used. Such materials have high hardness and elastic modulus and excellent high-temperature characteristics, and thus, when they are used as a reinforcing phase in an aluminum alloy, the strength, rigidity, high-temperature strength, wear-resistance, or the like of the aluminum alloy may be substantially increased. Due to such characteristics, many trials have been made to form such materials due to a spontaneous reaction.

DETAILED DESCRIPTION OF THE INVENTION

Technical Problem

However, reportedly, a conventional process for spontaneously producing a reinforcing material, such as titanium carbide, titanium boride, or alumina in molten aluminum requires heating the molten aluminum to 1000° C. or higher to induce a reaction. Maintaining the temperature of molten aluminum at as low level as possible is advantageous for the production of a material. This is because in addition to the aspect of an apparatus, when the temperature of molten metal is high, additive elements in the molten aluminum are highly likely to evaporate and the concentration of hydrogen, which contributes to a decrease in characteristics of an aluminum alloy, may increase.

One or more embodiments of the present invention include a method of stably preparing an aluminum composite with excellent mechanical properties while the temperature of molten aluminum is maintained at 950° C. or less. Additional aspects will be set forth in part in the description which follows and, in part, will be apparent from the description, or may be learned by practice of the presented embodiments.

Technical Solution

According to one or more embodiments of the present invention, a method of preparing an aluminum matrix composite includes mixing aluminum powder, a source material for titanium, a source material for a nonmetallic element that is able to be combined with titanium to form a compound, and an active material to prepare a precursor; adding the precursor to molten aluminum; and casting the molten aluminum.

According to one or more embodiments of the present invention, a method of preparing an aluminum matrix composite includes: mixing aluminum powder, a source material for titanium, and a source material for a nonmetallic element that is able to be combined with titanium to form a compound, to prepare a precursor; adding the precursor to molten aluminum; and casting the molten aluminum, wherein at least one of the aluminum powder, the source material for titanium, and the source material for a nonmetallic element is subjected to a plastic deformation.

The source material for titanium may include titanium oxide powder and the source material for the nonmetallic element may include carbon powder.

The source material for titanium may include titanium oxide powder and the source material for the nonmetallic element may include boron compound powder. The boron compound powder may include boron oxide powder or zirconium boride powder.

The source material for titanium may include titanium powder and the source material for the nonmetallic element may include carbon powder.

The active material may be a material that exothermically reacts with at least one of the aluminum powder, the source material for titanium, and the source material for nonmetallic element.

For example, the active material may be a material that exothermically reacts with aluminum, and for example, the active material may include at least one of copper oxide, cobalt oxide, manganese oxide, nickel oxide, iron oxide, vanadium oxide, chromium oxide, and tungsten oxide.

An amount of the active material may be in a range of 0.1 wt % to 40 wt % based on the precursor.

As another example, the active material may be a material that promotes decomposition of the titanium oxide.

As another example, the active material further includes, in addition to the material that exothermically reacts with at least one of the aluminum powder, the source material for titanium, and the source material for nonmetallic element, the material that promotes decomposition of the titanium oxide.

The material that promotes decomposition of the titanium oxide may include alkali metal, alkali earth metal, or an oxide of these, and for example, the material that promotes decomposition of the titanium oxide may include barium, calcium, strontium, potassium, and an oxide of any one of these.

The material that promotes decomposition of the titanium oxide has an amount of 5 wt % or less (greater than 0) based on the precursor.

The method may further include performing a plastic deformation process on at least one of the aluminum powder, the source material for titanium, and the source material for a nonmetallic element.

The precursor may include a pellet prepared by molding performed by mechanical pressing to mold or a product obtained by crushing the pellet.

The temperature of the molten aluminum may be equal to or higher than a melting point of aluminum and equal to or lower than 950° C.

Also, the molten aluminum may include one selected from pure molten aluminum and aluminum alloy molten metal containing at least one alloy element, and the alloy element may include magnesium (Mg), silicon (Si), copper (Cu), manganese (Mn), chromium (Cr), zinc (Zn), nickel (Ni), iron (Fe), tin (Sn), or lithium (Li).

According to one or more embodiments of the present invention, a method of preparing an aluminum matrix composite includes: dissolving an aluminum matrix composite prepared by using the method described above to form molten metal; adding an alloy element to the molten metal; and casting the molten metal.

According to one or more embodiments of the present invention, a method of preparing an aluminum matrix composite, includes: an aluminum matrix; and alumina and titanium compound particles which are distributed in the aluminum matrix, wherein the alumina and titanium compound particles are formed from a precursor including aluminum powder, a source material for titanium, a source material for a nonmetallic element that is able to be combined with titanium to form the titanium compound particles, and an active material.

According to one or more embodiments of the present invention, a method of preparing an aluminum matrix composite includes: an aluminum matrix; and alumina and titanium compound particles which are distributed in the aluminum matrix, wherein the alumina and titanium compound particles are formed from a precursor including aluminum powder, a source material for titanium, and a source material for a nonmetallic element that is able to be combined with titanium to form the titanium compound particles, and at least one of the aluminum powder, the source material for titanium, and the source material for a nonmetallic element is subjected to a plastic deformation.

The titanium compound particle may be a titanium carbide particle, the source material for titanium may include titanium oxide powder, and the source material for the nonmetallic element may include carbon powder.

The titanium compound particle may be titanium boride, the source material for titanium may include titanium oxide powder, and the source material for the nonmetallic element may include boron compound powder.

The titanium compound particle may be a titanium carbide particle, the source material for titanium may include titanium powder, and the source material for the nonmetallic element may include carbon powder.

Advantageous Effects

In the case of Comparative Example 6, even when the temperature of molten metal was raised up to 920° C., the reaction did not occur completely. FIG. 15 shows a microstructure of the aluminum matrix composite prepared according to Comparative Example 3, and it was confirmed that in the microstructure, Al3Ti, which was a coarse intermetallic compound (white arrow), was formed in addition to the titanium carbide. This result was confirmed from X-ray diffraction results of FIG. 16.

BEST MODE

Figure 1:
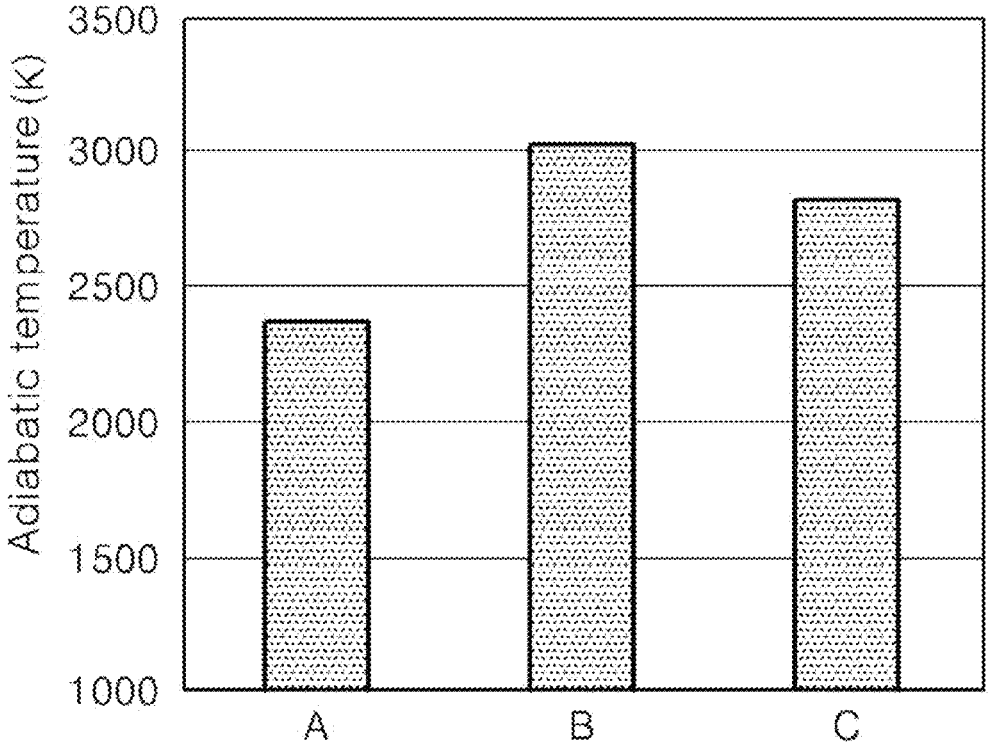
FIG. 1 shows a graph of adiabatic temperature due to heat generated from a reaction according to Reaction Schemes 1 and 2.

Reference will now be made in detail to embodiments, examples of which are illustrated in the accompanying drawings, wherein like reference numerals refer to the like elements throughout. In this regard, the present embodiments may have different forms and should not be construed as being limited to the descriptions set forth herein. Accordingly, the embodiments are merely described below, by referring to the figures, to explain aspects of the present description.

The present invention will now be described more fully with reference to the accompanying drawings, in which exemplary embodiments of the invention are shown. The invention may, however, be embodied in many different forms and should not be construed as being limited to the embodiments set forth herein; rather, these embodiments are provided so that this disclosure will be thorough and complete, and will fully convey the concept of the invention to those skilled in the art. Also, for convenience of description, the sizes of elements in the drawings may be exaggerated for clarity.

The term of 'molten aluminum' used herein refers to molten metal in which pure aluminum is dissolved or aluminum alloy molten metal containing at least one alloy element is dissolved.

To prepare an aluminum matrix composite, first, a precursor for forming a reinforcing material that is to be distributed in an aluminum matrix is provided. Herein, the precursor refers to a mixture of reaction materials that may react with each other in molten aluminum to form a reinforcing material. In this regard, the precursor may be a mixture including aluminum powder, a source material for titanium, a source material for a nonmetallic element that may be combined with titanium to form a compound, and an active material.

The source material for titanium refers to a material that supplies titanium to form a titanium compound, such as titanium carbide or titanium boride, in a matrix of an aluminum composite matrix. The source material for the nonmetallic element refers to a material that supplies a nonmetallic element that reacts with titanium supplied from the source material for titanium to form the titanium compound. The active material is a material for activating a reaction in the precursor, and will be described later in detail.

According to a first embodiment of the present invention, the source material for titanium may include titanium oxide powder, and the source material for the nonmetallic element may include carbon powder. In this regard, alumina and titanium carbide may be formed as a reinforcing material in a matrix of the aluminum composite.

Aluminum, titanium oxide and carbon may react to produce titanium carbide and alumina according to Reaction Scheme 1.

$$4Al+3TiO_2+3C \rightarrow 2Al_2O_3+3TiC \quad \text{[Reaction Scheme 1]}$$

This reaction is an exothermic reaction, once this reaction begins, the reaction spontaneously occurs. When a self combustion reaction using a spontaneous reaction occurs, due to the heat generated by the self reaction, a spontaneous combustion wave may propagate, whereby the reaction continues. Accordingly, when a precursor including aluminum, titanium oxide, and carbon is added to a high-temperature molten aluminum, the reaction according to Reaction Scheme 1 spontaneously occurs, thereby producing alumina and titanium carbide. In this regard, to induce the spontaneous reaction according to Reaction Scheme 1, the temperature of molten metal needs to be maintained at a temperature of 1000° C. or higher.

In casting aluminum, the temperature of molten aluminum needs to be maintained at as a low level as possible for the production of a material. That is, maintaining the temperature of molten metal at 1000° C. or higher requires an additional apparatus for supplying high energy. Also, an alloy element added to molten metal may highly likely evaporate while the molten metal is maintained, and the concentration of hydrogen in molten metal may increase. Hydrogen may deteriorate characteristics of aluminum alloy.

In the present embodiment, to reduce the temperature of molten aluminum, the active material may be included in the precursor to promote the reaction of the powders.

Herein, the active material may react with powders that constitute the precursor to cause an exothermic reaction. The active material may react with at least one of the powders to generate reaction heat to additionally supply heat in addition to the reaction heat generated when the reaction according to Reaction Scheme 1 occurs.

The active material may be a material that may react with aluminum to cause an exothermic reaction, and the material may include at least one selected from copper oxide, cobalt oxide, manganese oxide, nickel oxide, iron oxide, vanadium oxide, chromium oxide, and tungsten oxide.

For example, copper oxide reacts with aluminum as shown in Reaction Scheme 2 to produce a high amount of heat reaction.

$$2Al+3CuO \rightarrow Al_2O_3+3Cu \quad \text{[Reaction Scheme 2]}$$

FIG. 1 shows a graph of adiabatic temperature due to heat generated from a reaction according to Reaction Schemes 1 and 2. In FIG. 1, A indicates an adiabatic temperature value according to Reaction Scheme 1, and B indicates an adiabatic temperature value according to Reaction Scheme 2. Referring to A and B in FIG. 1, the adiabatic temperature of Reaction Scheme 1 is about 2368 K, and the adiabatic temperature of Reaction Scheme 2 is 3044 K. Accordingly, due to the heat generated according to Reaction Scheme 2, the reaction according to Reaction Scheme 1 may be promoted, and accordingly, a minimum temperature of molten aluminum, at which the reaction according to Reaction Scheme 1 spontaneously occurs, may decrease.

C in FIG. 1 shows an adiabatic temperature value according to Reaction Scheme 1 when copper oxide is added, and referring to this result, it is confirmed that the adiabatic temperature is raised up to 2833 K. This increase in the adiabatic temperature means that the temperature of molten metal for inducing Reaction Scheme 1 decreases as much as the increase.

According to another embodiment of the present invention, when nickel oxide reacts with aluminum, the adiabatic temperature is 3183 K, and in the case of iron oxide, the adiabatic temperature is 3133 K. That is, the nickel oxide and the iron oxide all show the same effects as obtained when the copper oxide is used.

According to another embodiment of the present invention, the active material may be a material that promotes decomposition of titanium oxide that constitutes the precursor. That is, the reaction according to Reaction Scheme 1 may be as follows: titanium oxide decomposes, and then, titanium (Ti) released therefrom is employed by aluminum that constitutes the precursor and then, the employed titanium reacts with carbon to generate titanium carbide. Accordingly, when the decomposition of the titanium oxide is promoted, the reaction according to Reaction Scheme 1 may be promoted.

The active material may be an element that is alkali metal or alkali earth metal shown in the Periodic Table or an oxide of the element. For example, the active material may be barium (Ba), calcium (Ca), strontium (Sr), potassium (K), or an oxide thereof.

As another example for the promotion of the reaction among the powders that constitute the precursor, at least one of the powders that constitute the precursor added to the molten aluminum may be subjected to a plastic deformation.

For example, aluminum powder, titanium oxide powder, and carbon powder are placed in an apparatus, such as a ball mill, that performs a plastic deformation on powder, and then, for a predetermined period of time, the powders are mechanically deformed to energetically activate the powders. The powders that have been subjected to the plastic deformation process are mixed, and then, molded in the form of a pellet, thereby completing the preparation of the precursor to be added to the molten aluminum.

When this method is used, due to the activation of powders due to the plastic deformation process, the reaction according to Reaction Scheme 1 is promoted and ultimately, at a far lower molten aluminum temperature, the reaction according to Reaction Scheme 1 may spontaneously occur.

From among these methods of promoting the reaction among the powders that constitute the precursor, two or more thereof may be optionally combined. For example, an active material that exothermically reacts with aluminum and an active material that promotes decomposition of titanium oxide may be used together. Alternatively, at least one of these active materials may be mixed with aluminum powder, titanium oxide powder, and carbon powder, and then, a plastic deformation process is mechanically performed on the mixture to prepare the precursor.

An amount of the active material that is added to raise the adiabatic temperature by the reaction with aluminum may be, based on the precursor, in a range of 0.1 wt % to 40 wt %, preferably 0.5 wt % to 40 wt %, more preferably 1 wt % to 40 wt %, or even more preferably 3 wt % to 40 wt %.

In the case of the active material that is used to raise the adiabatic temperature, when the active material has a smaller particle size, the active material may be added in a smaller composition ratio. This is because when an active material has a smaller particle size, the entire surface area increases.

However, when the amount of the active material is less than 0.1 wt %, actually, the addition of the active material may not result in an increase in the adiabatic temperature. Accordingly, the active material may be added in an amount of at least 0.1 wt % or more, 0.5 wt % or more, 1 wt % or more, or 3 wt % or more to completely react with aluminum.

Also, when the amount of the active material exceeds 40 wt %, the active material may affect casting characteristics of the molten aluminum or characteristics of an aluminum matrix. For example, in the case of copper oxide, copper oxide is reduced by aluminum to produce copper (Cu), and when the copper obtained by the reduction is present in great quantities in molten aluminum, casting characteristics of molten metal may decrease, and when the prepared material is processed by pressing or extrusion, processability may decrease.

The active material that is added to promote the decomposition of titanium oxide may be added in an amount of 5 wt % or less (greater than 0) to the precursor. When the amount of the active material is 5 wt %, the active material may exist in the molten aluminum and may lead to an increase in viscosity of molten metal. Also, the active material may refine (modify) eutectic silicon in a composite including a matrix that is formed of silicon (Si)-added aluminum-silicon alloy.

According to a second embodiment of the present invention, the source material for titanium may include titanium oxide powder and the source material for the nonmetallic element may include boron compound powder. In this regard, alumina and titanium boride may be formed as a reinforcing material in a matrix of the aluminum composite.

To form alumina and titanium boride, aluminum (Al) powder, boron (B) powder, and titanium oxide (TiO2) may react according to Reaction Scheme 3.

$$4Al+3TiO_2+6B \rightarrow 2Al_2O_3+3TiB_2 \quad \text{[Reaction Scheme 3]}$$

In Reaction Scheme 3, a boron compound may be used instead of boron, and the boron compound may be, for example, boron oxide ($B_2O_3$) or zirconium boride ($ZrB_{12}$). When boron oxide is used as a boron compound, alumina and titanium boride may be formed according to Reaction Scheme 4 below.

$$10Al+3TiO_2+3B_2O_3 \rightarrow 5Al_2O_3+3TiB_2 \quad \text{[Reaction Scheme 4]}$$

This reaction is an exothermic reaction, once this reaction begins, the reaction spontaneously occurs. When a self combustion reaction using a spontaneous reaction occurs, due to the heat generated by the self reaction, a spontaneous combustion wave may propagate, whereby the reaction continues. Accordingly, when a precursor including aluminum, boron oxide, and titanium oxide is added to a high-temperature molten aluminum, the reaction according to Reaction Scheme 3 spontaneously occurs, and thus, alumina and titanium boride are produced.

The reaction according to Reaction Scheme 3 may occur in molten aluminum having as low temperature as possible, and to do this, according to an embodiment of the present invention, the precursor may further include an active material that promotes a reaction among the powders. The active material may be a material that causes an exothermic reaction with any one of the powders that constitute the precursor. The active material may react with at least one of the powders to generate reaction heat to additionally supply heat in addition to the reaction heat generated when the reaction according to Reaction Scheme 3 occurs.

The active material may be a material that may react with aluminum to cause an exothermic reaction, and the material may include at least one selected from copper oxide, cobalt oxide, manganese oxide, nickel oxide, iron oxide, vanadium oxide, chromium oxide, and tungsten oxide.

For example, copper oxide reacts with aluminum as shown in Reaction Scheme 5 to produce a high intensity of reaction heat.

$$2Al+3CuO \rightarrow Al_2O_3+3Cu \quad \text{[Reaction Scheme 5]}$$

Figure 2:
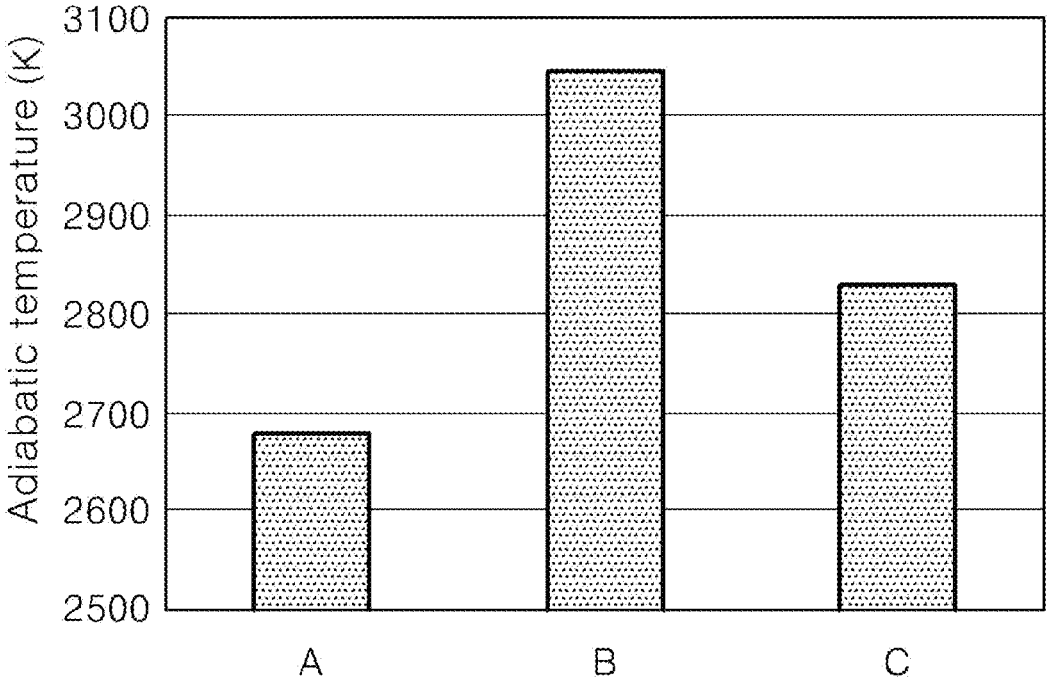
FIG. 2 shows a graph of adiabatic temperature due to heat generated from a reaction according to Reaction Schemes 4 and 5.

FIG. 2 shows a graph of adiabatic temperature due to heat generated from a reaction according to Reaction Schemes 4 and 5. In FIG. 2, A indicates an adiabatic temperature value according to Reaction Scheme 4, and B indicates an adiabatic temperature value according to Reaction Scheme 5. Referring to FIG. 2, the adiabatic temperature of Reaction Scheme 4 is about 2682 K, and the adiabatic temperature of Reaction Scheme 5 is 3044 K. Accordingly, due to the heat generated according to Reaction Scheme 5, the reaction according to Reaction Scheme 4 may be promoted, and accordingly, a minimum temperature of molten aluminum at which the reaction according to Reaction Scheme 4 spontaneously occurs may decrease.

C in FIG. 2 shows an adiabatic temperature value according to Reaction Scheme 4 when copper oxide is added, and referring to this result, it is confirmed that the adiabatic temperature is raised up to 2833 K. This increase in the adiabatic temperature means that the temperature of molten metal for inducing Reaction Scheme 4 decreases as much as the increase.

According to another embodiment of the present invention, when nickel oxide reacts with aluminum, the adiabatic temperature is 3183 K, and in the case of iron oxide, the adiabatic temperature is 3133 K. That is, the nickel oxide and the iron oxide all show the same effects as obtained when the copper oxide is used.

According to another embodiment of the present invention, the active material may be a material that promotes decomposition of titanium oxide that constitutes the precursor. That is, the reaction according to Reaction Scheme 4 may be as follows: titanium oxide decomposes, and then, titanium (Ti) released therefrom is employed by aluminum that constitutes the precursor and then, the employed titanium reacts with boron that is produced by the decomposition of the boron oxide to produce titanium boride. Accordingly, when the decomposition of the titanium oxide is promoted, the reaction according to Reaction Scheme 4 may be promoted.

The active material may be an alkali metal or alkali earth metal shown in the Periodic Table or an oxide thereof. For example, the active material may be barium (Ba), calcium (Ca), strontium (Sr), potassium (K), or an oxide thereof.

As another example for the promotion of the reaction among the powders that constitute the precursor, at least one of the powders that constitute the precursor added to the molten aluminum may be subjected to a plastic deformation.

For example, aluminum powder, boron oxide powder, and titanium oxide powder are placed in an apparatus, such as a ball mill, that performs a plastic deformation process on powder, and then, for a predetermined period of time, the powders are mechanically deformed to energetically activate the powders. The powders that have been subjected to the plastic deformation process are mixed, and then, molded in the form of a pellet, thereby completing the preparation of the precursor to be added to the molten aluminum.

When this method is used, due to the activation of powders obtained by performing the plastic deformation process, the reaction according to Reaction Scheme 4 is promoted and ultimately, at a far lower molten aluminum temperature, the reaction according to Reaction Scheme 4 may spontaneously occur.

From among these methods of promoting the reaction among the powders that constitute the precursor, two or more thereof may be optionally combined. For example, an active material that exothermically reacts with aluminum and an active material that promotes decomposition of titanium oxide may be used together. Alternatively, at least one of these active materials may be mixed with aluminum powder, boron oxide powder, and titanium oxide powder, and then, a plastic deformation process is mechanically performed on the mixture to prepare the precursor.

An amount of the active material that is added to raise the adiabatic temperature by the reaction with aluminum may be, based on the precursor, in a range of 0.1 wt % to 40 wt %, 0.5 wt % to 40 wt %, 1 wt % to 40 wt %, or 3 wt % to 40 wt %.

In the case of the active material that is used to raise the adiabatic temperature, when the active material has a smaller particle size, the active material may be added in a smaller composition ratio. This is because when an active material has a smaller particle size, the entire surface area increases.

However, when the amount of the active material is less than 0.1 wt %, actually, the addition of the active material may not result in an increase in the adiabatic temperature. Accordingly, the active material may be added in an amount of at least 0.1 wt % or more, 0.5 wt % or more, 1 wt % or more, or 3 wt % or more to completely react with aluminum.

Also, when the amount of the active material exceeds 40 wt %, the active material may affect casting characteristics of molten aluminum or characteristics of an aluminum matrix. For example, in the case of copper oxide, copper oxide is reduced by aluminum to produce copper (Cu), and when the copper obtained by the reduction is present in great quantities in molten aluminum, casting characteristics of molten metal may decrease, and when the prepared material is processed by pressing or extrusion, processability may decrease.

The active material that is added to promote the decomposition of titanium oxide may be added in an amount of 5 wt % or less to the precursor. When the amount of the active material is 5 wt %, the active material may exist in the molten aluminum and may lead to an increase in viscosity of molten metal. Also, the active material may refine (modify) the eutectic silicon in a composite including a matrix that is formed of silicon (Si)-added aluminum-silicon alloy.

In the present embodiment, boron oxide ($B_2O_3$) was used as a boron compound. However, according to another embodiment of the present invention, zirconium boride ($ZrB_{12}$) may be used instead of the boron oxide.

According to a third embodiment of the present invention, the source material for titanium may include titanium powder, and the source material for the nonmetallic element may include carbon powder. In this regard, titanium carbide may be formed as a reinforcing material in a matrix of the aluminum composite.

Carbon and titanium may react with each other according to Reaction Scheme 6 to produce titanium carbide.

$$Ti+C \rightarrow TiC \quad \text{[Reaction Scheme 6]}$$

This reaction is an exothermic reaction, once this reaction begins, the reaction spontaneously occurs. When a self combustion reaction using a spontaneous reaction occurs, due to the heat generated by the self reaction, even when energy is not externally supplied thereto, a combustion wave may spontaneously propagate, whereby the reaction continues. However, when titanium carbide is produced in molten aluminum according to Reaction Scheme 6, titanium may not directly react with carbon to produce titanium carbide, but aluminum is needed as an intermediate. That is, according to Reaction Scheme 7 and Reaction Scheme 8 below, $Al_3Ti$ and $Al_4C_3$, which are intermediates, are produced, and these intermediates react with each other to form, finally, titanium carbide according to Reaction Scheme 9.

$$3Al+Ti=Al_3Ti \quad \text{[Reaction Scheme 7]}$$

$$4Al+3C=Al_4C_3 \quad \text{[Reaction Scheme 8]}$$

$$3Al_3Ti+Al_4C_3=3TiC+13Al \quad \text{[Reaction Scheme 9]}$$

Accordingly, when a precursor including aluminum powder, titanium powder, and carbon powder is added to a high-temperature molten aluminum, the reaction according to Reaction Scheme 6 spontaneously occurs, and thus, titanium carbide is produced.

Figure 3:
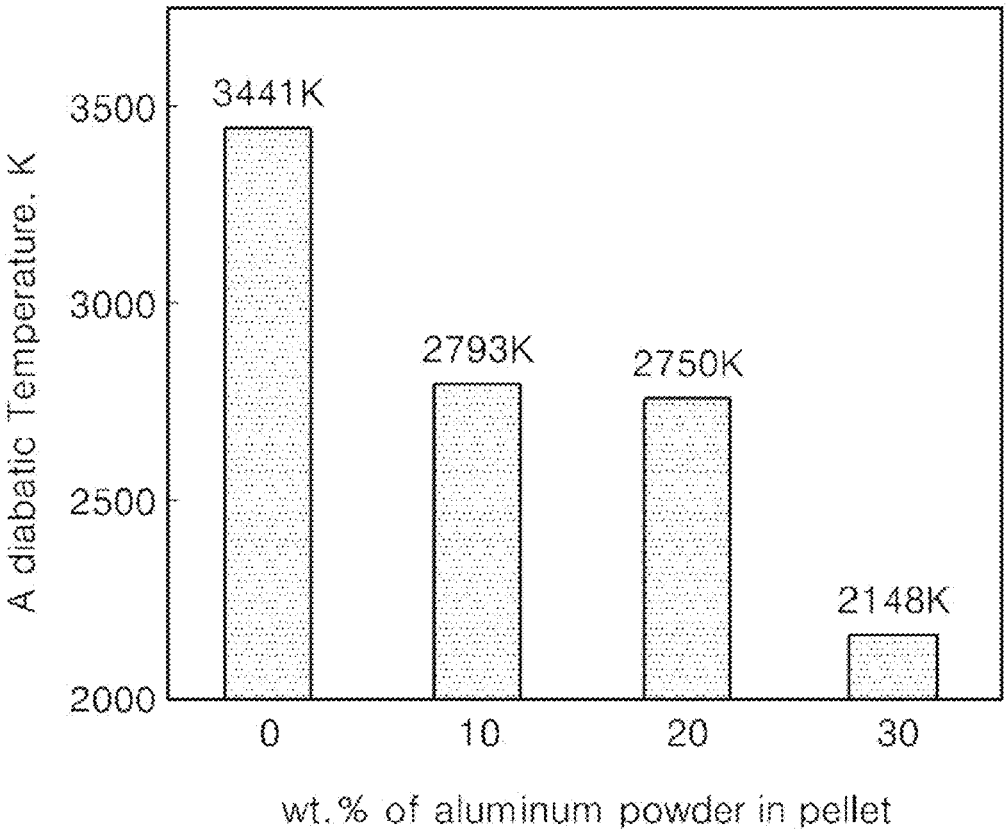
FIG. 3 shows a graph of adiabatic temperature due to heat generated from a reaction according to Reaction Scheme 6.

FIG. 3 is a graph of an adiabatic temperature of titanium carbide, that is, a graph of adiabatic temperature (K) of Reaction Scheme 6 according to an amount (wt. %) of aluminum powder added to a pellet.

Referring to FIG. 3, as described above, intermediates need to be produced to generate titanium carbide in molten aluminum according to Reaction Scheme 6, and for the production of the intermediates, a predetermined amount of aluminum needs to be added to a mixed powder. However, the addition of aluminum leads to a rapid decrease in the adiabatic temperature, and this means that a reaction heat decreases and a reaction rate decreases.

When the adiabatic temperature decreases, the reaction according to Reaction Scheme 6 does not occur completely in molten aluminum and thus, an intermetallic compound, such as $Al_3Ti$, may be generated in an aluminum matrix. Although the intermetallic compound has a very high hardness, it also has high brittleness properties. Accordingly, when the intermetallic compound exists in great quantities in a microstructure, mechanical properties may decrease. Also, when $Al_3Ti$ is present in molten metal, viscosity of the molten metal may increase and fluidity thereof may decrease, whereby casting characteristics thereof decrease. Accordingly, to induce the reaction according to Reaction Scheme 6 to occur spontaneously, the temperature of the molten metal needs to be maintained at 1000° C. or more.

As described above, in casting aluminum, molten aluminum may have as low temperature as possible. Accordingly, to reduce the temperature of molten aluminum while the reaction for the production of titanium carbide is not affected, the precursor may further include an active material that exothermically reacts with any one of titanium powder, carbon powder, and aluminum powder to promote a reaction.

For example, copper oxide (CuO) may react with aluminum according to Reaction Scheme 10 below:

$$2Al+3CuO \rightarrow Al_2O_3+3Cu \quad \text{[Reaction Scheme 10]}$$

The reaction according to Reaction Scheme 10 is an exothermic reaction, and thus, due to the heat generated by this reaction, the adiabatic temperature may be raised. Accordingly, the decrease in the adiabatic temperature due to the addition of aluminum may be prevented, and the reaction may completely occur at a lower temperature.

That is, the exothermic reaction of metal oxide may compensate for the decrease in the adiabatic temperature due to the additionally mixed aluminum in the reaction according to Reaction Scheme 6; at a lower molten aluminum temperature, the reaction according to Reaction Scheme 6 may spontaneously occur; the reaction may be promoted to suppress the remaining of intermetallic compound; and a synthesis reaction of titanium carbide may smoothly occur.

Figure 4:
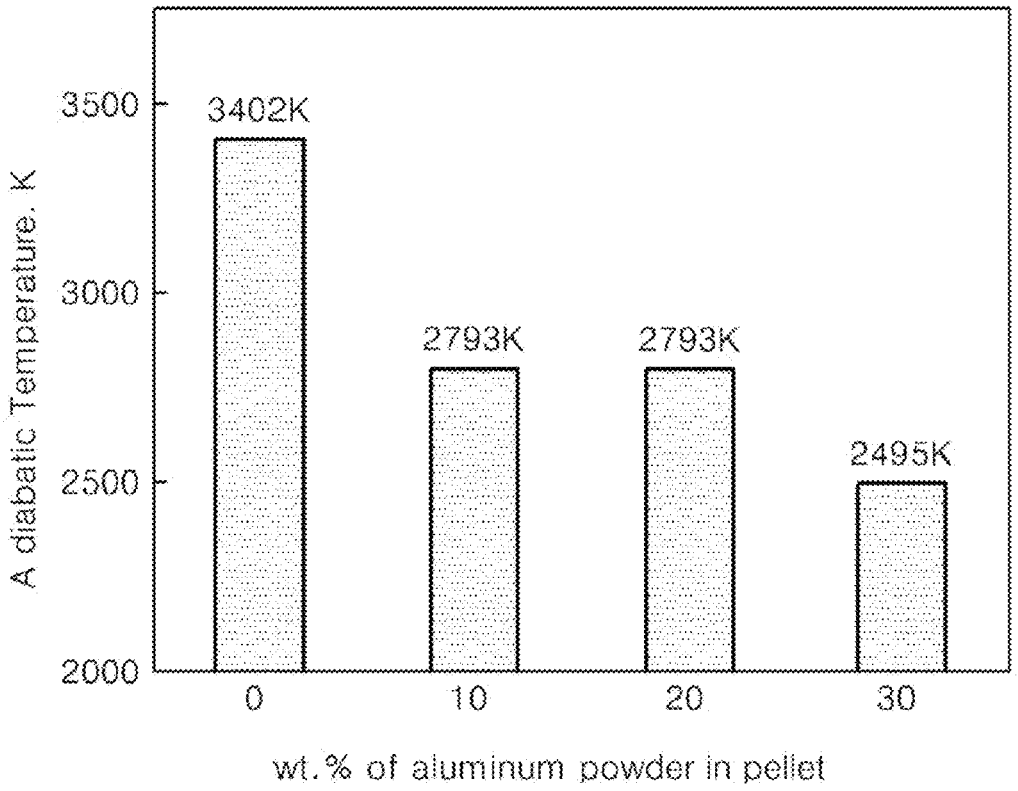
FIG. 4 shows a change in the adiabatic temperature when 7 to 8 wt % of copper oxide is added to the reaction according to Reaction Scheme 6.

FIG. 4 shows a change in the adiabatic temperature when 7 to 8 wt % of copper oxide is added to the reaction according to Reaction Scheme 6.

Referring to FIGS. 3 and 4, when the amount of the aluminum powder is 20 wt % or more, it is confirmed that the adiabatic temperature is raised compared to the adiabatic temperature affected by only the reaction according to Reaction Scheme 6. In the case of Reaction Scheme 6, when aluminum powder is added in an amount of 20 wt %, the adiabatic temperature was 2750 K. However, when copper oxide is further added, at the same aluminum amount, the adiabatic temperature is raised to 2793 K. When the amount of aluminum powder is 30 wt % and copper oxide is added, the adiabatic temperature is 2148 K; and when the amount of aluminum powder is 30 wt % and copper oxide is not added, the adiabatic temperature is 2495 K. That is, it was confirmed that the addition of copper oxide results in an increase of the adiabatic temperature—about 350 K. Accordingly, due to the addition of copper oxide, a synthesis reaction of titanium carbide may be promoted, and accordingly, a minimum temperature of molten aluminum, at which the reaction according to Reaction Scheme 6 spontaneously occurs, may decrease.

Herein, copper oxide is an example of the active material, and may exothermically react with the precursor powder including aluminum powder. The active material may react with precursor material containing aluminum to generate reaction heat to additionally supply heat in addition to the reaction heat generated when the reaction according to Reaction Scheme 6 occurs.

The active material may be a material that may react with aluminum to cause an exothermic reaction, and may include at least one selected from copper oxide, cobalt oxide, manganese oxide, nickel oxide, iron oxide, vanadium oxide, chromium oxide, and tungsten oxide.

An amount of the active material that is added to raise the adiabatic temperature by the reaction with aluminum may be, based on the precursor, in a range of 0.1 wt % to 40 wt %, 0.5 wt % to 40 wt %, 1 wt % to 40 wt %, or 3 wt % to 40 wt %.

In the case of the active material that is used to raise the adiabatic temperature, when the active material has a smaller particle size, the active material may be added in a smaller composition ratio. This is because when an active material has a smaller particle size, the entire surface area increases.

However, when the amount of the active material is less than 0.1 wt %, actually, the addition of the active material may not result in an increase in the adiabatic temperature. Accordingly, the active material may be added in an amount of at least 0.1 wt % or more, 0.5 wt % or more, 1 wt % or more, or 3 wt % or more to completely react with aluminum.

Also, when the amount of the active material exceeds 40 wt %, the active material may affect casting characteristics of the molten aluminum or characteristics of an aluminum matrix. For example, in the case of copper oxide, copper oxide is reduced by aluminum to produce copper (Cu), and when the copper obtained by the reduction is present in great quantities in molten aluminum, casting characteristics of molten metal may decrease, and when the prepared material is processed by pressing or extrusion, processability may decrease.

As another example for the promotion of the reaction among the powders that constitute the precursor, at least one of the powders that constitute the precursor added to the molten aluminum may be subjected to a plastic deformation process.

For example, titanium powder, carbon powder, and aluminum powder are placed in an apparatus, such as a ball mill, that performs a plastic deformation process on powder, and then, for a predetermined period of time, the powders are mechanically and plastically deformed to energetically activate the powders.

When this method is used, due to the activation of powders obtained by performing the plastic deformation process, the reaction according to Reaction Scheme 6 is promoted and ultimately, at a far lower molten aluminum temperature, the reaction according to Reaction Scheme 6 may spontaneously occur.

From among these methods of promoting the reaction among the powders that constitute the precursor, two or more thereof may be optionally combined. For example, aluminum powder, titanium powder, and carbon powder are mixed and then, the mixture is subjected to mechanical plastic deformation, and then, an active material that exothermically reacts with aluminum is added thereto to prepare a precursor, or an active material that exothermically reacts with aluminum is mixed with aluminum powder, titanium powder, and carbon powder, and then, the mixture is subjected with mechanical and plastic deformation to prepare a precursor.

The precursors prepared by adding the active material or performing a plastic deformation as described in the first through third embodiments may be formed in a pellet form. In this regard, the pellet may be directly added to molten aluminum or may be crushed in a predetermined size and then the result is added thereto. The precursor is added into molten aluminum and then maintained for a predetermined period of time, and then, the resultant molten aluminum is cast to prepare an aluminum matrix composite. In this regard, the temperature of molten metal may be maintained at 950° C. or less.

Also, in the first to third embodiments, molten aluminum may be prepared by dissolving pure aluminum or adding at least one alloy element to pure aluminum. Examples of the alloy element are magnesium (Mg), silicon (Si), copper (Cu), manganese (Mn), chromium (Cr), zinc (Zn), nickel (Ni), iron (Fe), tin (Sn), and lithium (Li).

Also, aluminum matrix composites (first aluminum matrix composite) prepared according to the embodiments of the present invention are dissolved to form molten metal, and then, the alloy elements are added thereto and the resultant molten aluminum is cast to prepare aluminum matrix composites (second aluminum matrix composite). For example, the first aluminum matrix composite may include a pure aluminum matrix and titanium carbide and alumina which are reinforcing phases, and when the first aluminum matrix composite is dissolved and an alloy element that is selected in consideration of purpose or alloy design is added thereto to prepare a second aluminum matrix composite that is suitable for desired characteristics.

Hereinafter, experimental examples are provided to help understanding of the present invention. However, the experimental examples are provided herein for illustration purpose only, and the present invention is not limited thereto.

Table 1 shows a composition of a precursor used in preparing an aluminum matrix composite in which alumina and titanium carbide are dispersed as a reinforcing material and the temperature of molten metal maintained during reaction.

TABLE 1

| Sample | Molten metal | Composition of pellet (wt %) | | | | | | Temperature of molten metal (° C.) | Reaction |
|---|---|---|---|---|---|---|---|---|---|
| | | CuO | $TiO_2$ | C | CaO | $SrO_2$ | Al | | |
| Experimental Example 1 | pure aluminum | 31.3 | 31.7 | 4.8 | 0 | 0 | bal. | 850 | reaction |
| Experimental Example 2 | pure aluminum | 22.2 | 33.7 | 5.0 | 0 | 0 | bal. | 900 | reaction |
| Experimental Example 3 | pure aluminum | 21.1 | 42.7 | 6.4 | 1.0 | 0 | bal. | 900 | reaction |
| Experimental Example 4 | pure aluminum | 21.1 | 42.7 | 6.4 | 0 | 1.1 | bal. | 900 | reaction |
| Experimental Example 5 | A356 | 31.3 | 31.7 | 4.8 | 0 | 0 | bal. | 880 | reaction |
| Experimental Example 6 | A6061 | 31.3 | 31.7 | 4.8 | 0 | 0 | bal. | 880 | reaction |
| Comparative Example 1 | pure aluminum | 0 | 58.4 | 8.8 | 0 | 0 | bal. | 930 | non-reaction |

The precursors prepared according to Experimental Examples 1, 2, 5, and 6 were prepared by adding copper oxide powder to aluminum powder, titanium oxide powder, and carbon powder. In Experimental Example 3, calcium oxide was further used in addition to the above-mentioned powders, and in Experimental Example 4, strontium oxide was further added to copper oxide powder, aluminum powder, titanium oxide powder, and carbon powder.

Also, molten metal used in Experimental Examples 1 to 4 was prepared by cutting a pure aluminum ingot and completely dissolving the cut pure aluminum ingot in a furnace, and in Experimental Examples 5 and 6, A356 alloy and A6061 alloy, which are commercially available aluminum alloy, were used to form molten metal.

Also, according to comparative examples, which were used to compare with the experimental examples, a precursor including aluminum powder, titanium oxide powder and carbon powder was added to pure molten aluminum.

In the experimental examples and comparative examples, a precursor that was prepared in the form of a pellet by molding mixed powder under pressure by using a press was added to molten metal, and after the consumption of the pellet due to complete reaction was confirmed, the resultant molten metal was stirred by using a graphite rod and then cast into a mold.

Figure 5:
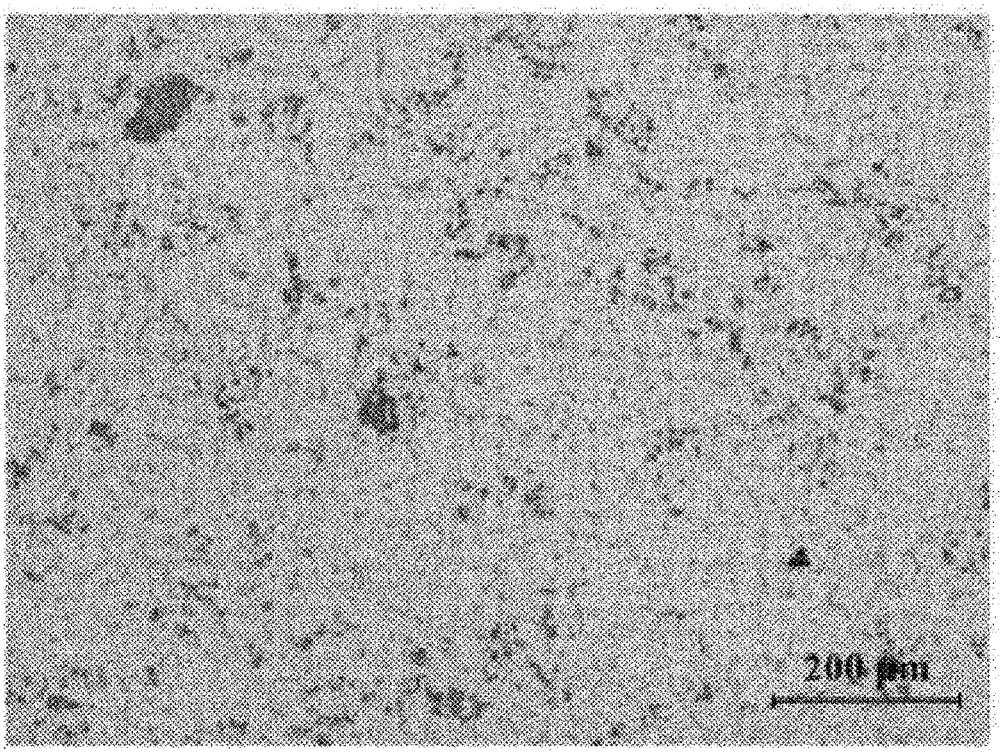
FIG. 5 shows a microstructure of an aluminum matrix composite prepared according to Experimental Example 1.
Figure 6:
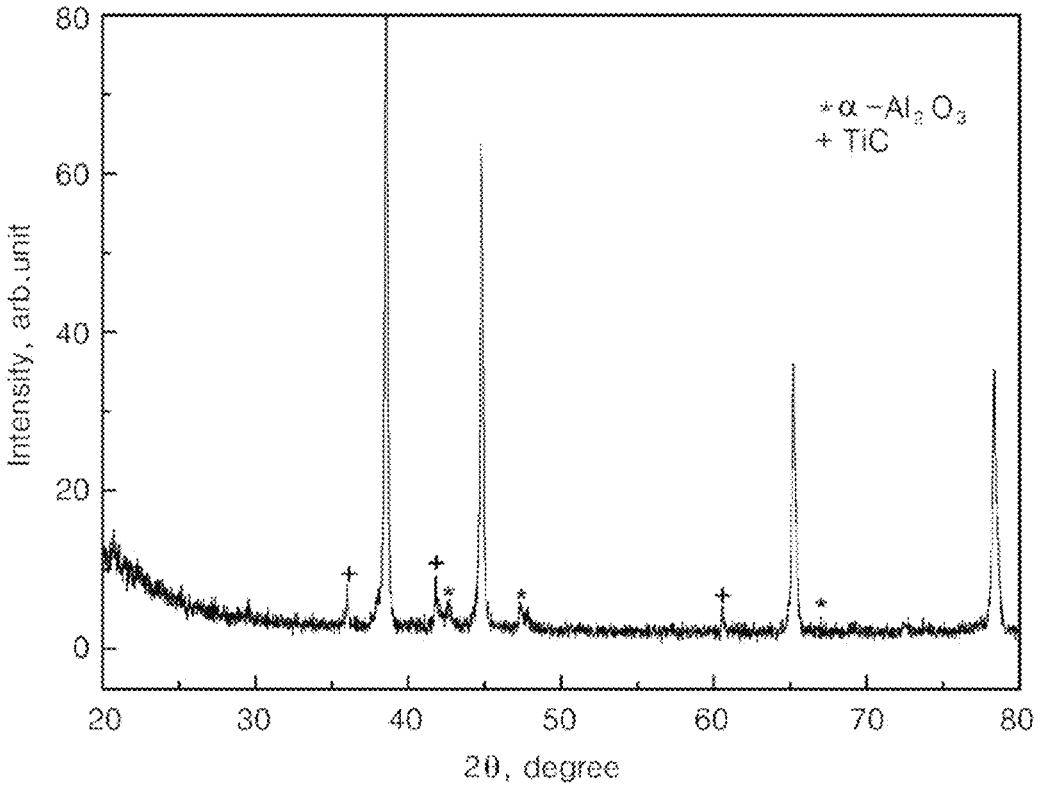
FIG. 6 shows X-ray diffraction analysis results of an aluminum matrix composite prepared according to Experimental Example 1.

Referring to Table 1, it was confirmed that in Experimental Examples 1 to 6, titanium carbide and alumina were produced at the molten metal temperature of 900° C. or less. FIG. 5 shows a microstructure of the aluminum matrix composite prepared according to Experimental Example 1, and referring to FIG. 5, it was confirmed that fine titanium carbide and alumina particles (black particles) were generated in a matrix, and the generation of fine titanium carbide and alumina particles was confirmed from X-ray diffraction analysis results of FIG. 6.

Figure 7:
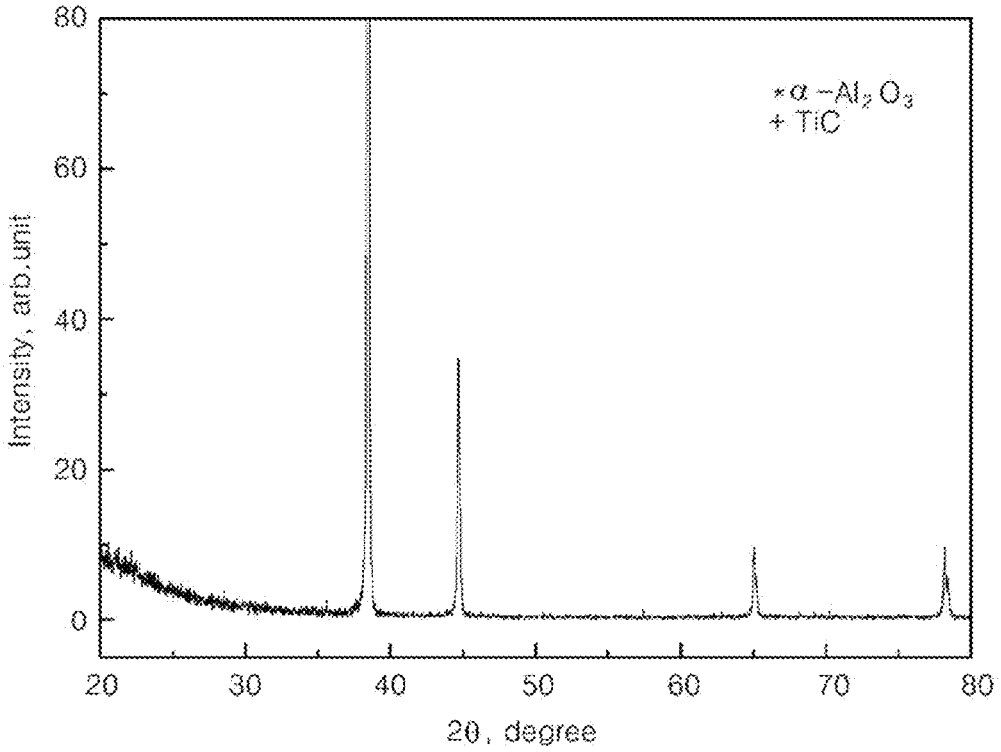
FIG. 7 shows X-ray diffraction analysis results of an aluminum matrix composite prepared according to Comparative Example 1.

However, in Comparative Example 1, even when the precursor was added to molten metal that had been maintained at a temperature of 930° C., and then, maintained for 10 minutes or more, no reaction occurred. The resultant molten metal was cast and then the result was subjected to X-ray diffraction analysis. However, the resultant X-ray diffraction spectrum of Comparative Example 1 did not have diffraction peaks of titanium carbide or alumina (FIG. 7). From this result, it was confirmed that in the case of Comparative Example 1, at the molten metal temperature of 950° C. or less, it was failed to obtain an aluminum composite that was reinforced with titanium carbide and alumina.

Table 2 shows a composition of a precursor used in preparing an aluminum matrix composite in which alumina and titanium boride are dispersed as a reinforcing material and the temperature of molten metal maintained during reaction.

TABLE 2

| Sample | Matrix alloy | Composition of pellet (wt %) | | | | | | | Temperature of moton metal | Reaction |
|---|---|---|---|---|---|---|---|---|---|---|
| | | CuO | $TiO_2$ | $B_2O_3$ | $ZrB_{12}$ | CaO | $SrO_2$ | Al | (° C.) | |
| Experimental Example 7 | pure aluminum | 20.7 | 20.9 | 18.3 | — | — | — | Bal. | 880 | reaction |
| Experimental Example 8 | pure aluminum | 11.8 | 24.0 | 21.0 | — | — | — | Bal. | 900 | reaction |
| Experimental Example 9 | A356 | 11.8 | 24.0 | 21.0 | — | — | — | Bal. | 890 | reaction |
| Experimental Example 10 | A6061 | 11.8 | 24.0 | 21.0 | — | — | — | Bal. | 895 | reaction |
| Experimental Example 11 | pure aluminum | 6.3 | 25.7 | 22.5 | — | 0.6 | — | Bal. | 900 | reaction |
| Experimental Example 12 | pure aluminum | 6.3 | 25.7 | 22.5 | — | — | 0.6 | Bal. | 900 | reaction |
| Experimental Example 13 | pure aluminum | 17.6 | 35.7 | — | 16.5 | — | — | Bal. | 900 | reaction |
| Experimental Example 14 | pure aluminum | 9.9 | 40.1 | — | 18.5 | — | — | Bal. | 910 | reaction |
| Comparative Example 2 | pure aluminum | — | 28.1 | 24.6 | — | — | — | Bal. | 930 | non-reaction |
| Comparative Example 3 | pure aluminum | — | 45.6 | — | 21.0 | — | — | Bal. | 930 | non-reaction |

The precursors used in Experimental Examples 7 to 12 were each prepared by using aluminum powder, copper oxide powder, titanium oxide powder, and boron oxide powder. In Experimental Example 11, calcium oxide (CeO) was further used in addition to the above-mentioned powders, and in Experimental Example 12, strontium oxide ($SrO_2$) was additionally used in addition to aluminum powder, copper oxide powder, titanium oxide powder, and boron oxide powder.

Molten metal used in experimental examples and comparative examples other than Experimental Examples 9 and 10 was prepared by cutting a pure aluminum ingot and completely dissolving the cut pure aluminum ingot in a furnace, and in Experimental Examples 9 and 10, A356 alloy and A6061 alloy, which are commercially available aluminum alloy, were used to form molten metal.

In the experimental examples and comparative examples, a precursor that was prepared in the form of a pellet by molding mixed powder under pressure by using a press was added to molten metal, and after the consumption of the pellet due to complete reaction was confirmed, the resultant molten metal was stirred by using a graphite rod and then cast into a mold.

Figure 8:
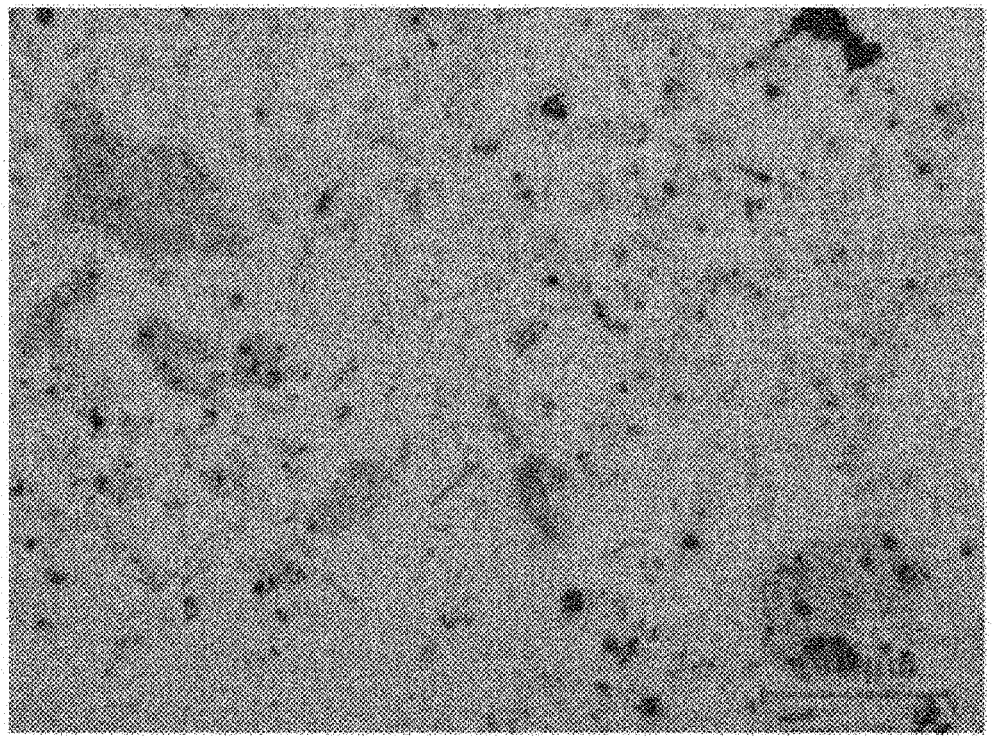
FIG. 8 shows a microstructure of an aluminum matrix composite prepared according to Experimental Example 8.
Figure 9:
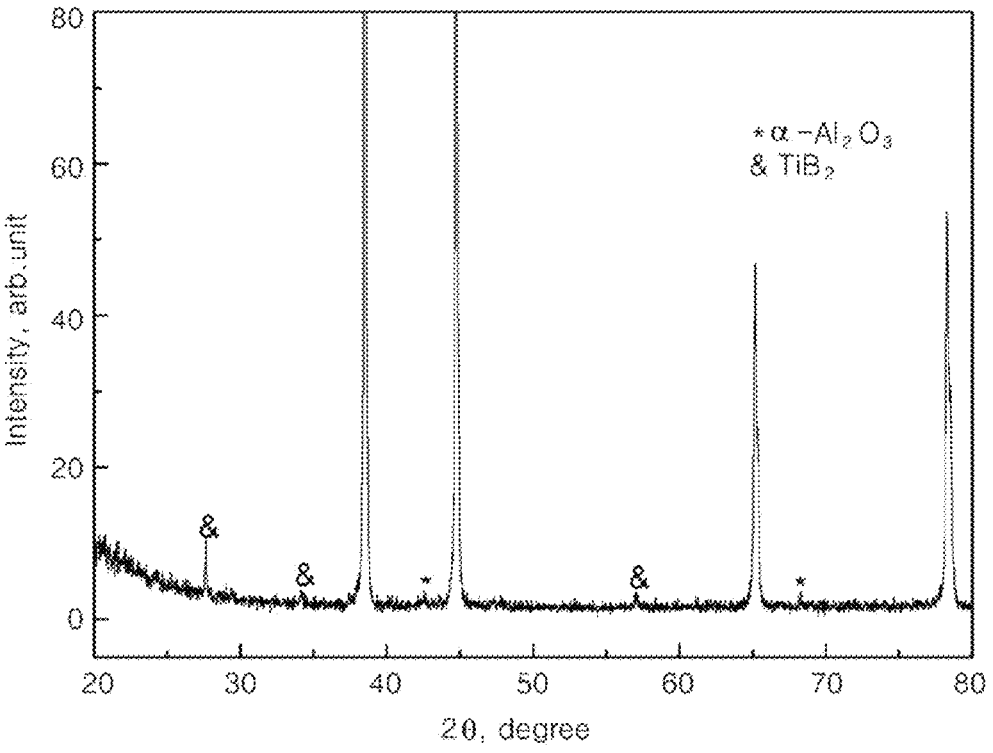
FIG. 9 shows X-ray diffraction analysis results of the aluminum matrix composite prepared according to Experimental Example 8.

Referring to Table 2, it was confirmed that in Experimental Examples 7 to 14, alumina and titanium boride were produced at the molten metal temperature of 910° C. or less. FIG. 8 shows a microstructure of the aluminum matrix composite prepared according to Experimental Example 8, and referring to FIG. 8, it was confirmed that fine titanium boride (gray particles) and alumina particles (black particles) were generated in a matrix, and the generation of fine titanium carbide and alumina particles was confirmed from X-ray diffraction analysis results of FIG. 9.

Figure 10:
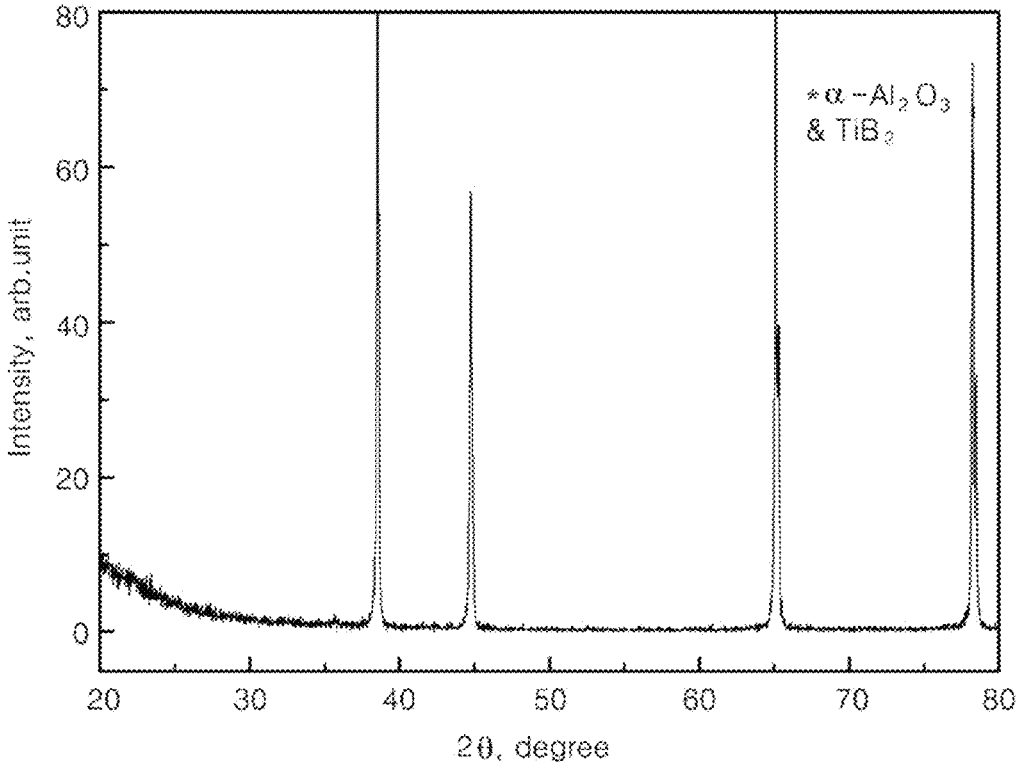
FIG. 10 shows X-ray diffraction analysis results of an aluminum matrix composite prepared according to Comparative Example 2.

However, in Comparative Example 2, a precursor was prepared by adding aluminum powder, titanium oxide powder, and boron oxide powder without copper oxide powder. The precursor was added to molten metal that had been maintained at a temperature of 930° C. However, even 10 minutes after the addition of the precursor, any reaction did not occur. The resultant molten metal was cast and then the result was subjected to X-ray diffraction analysis. However, the resultant X-ray diffraction spectrum of Comparative Example 1 did not have diffraction peaks of titanium boride or alumina (FIG. 10).

Figure 11:
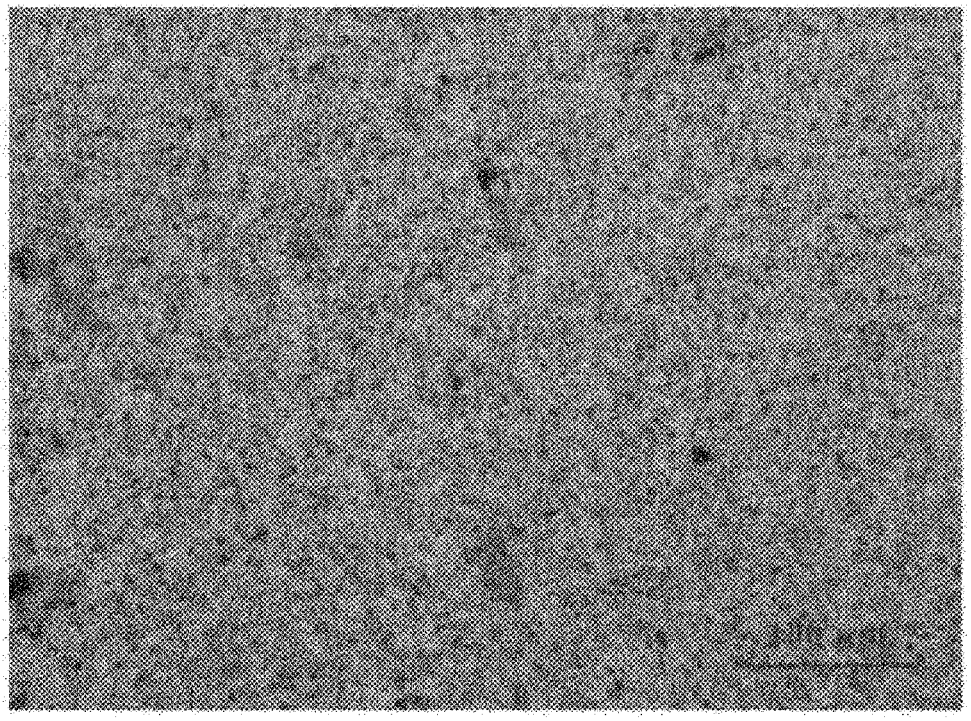
FIG. 11 shows a microstructure of an aluminum matrix composite prepared according to Experimental Example 13.
Figure 12:
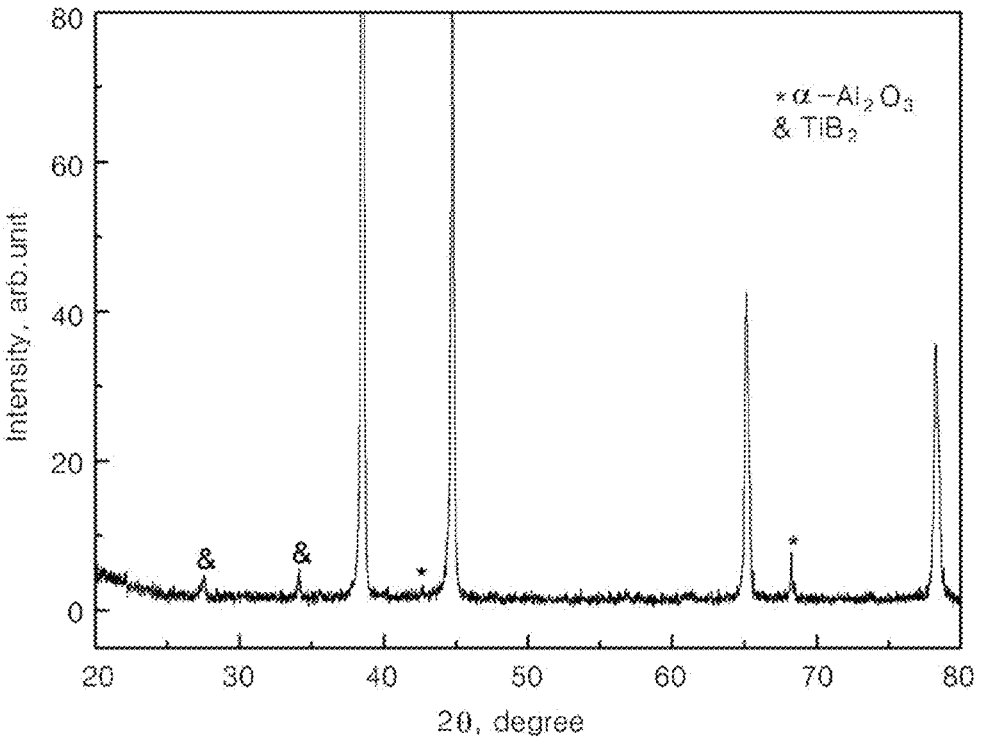
FIG. 12 shows X-ray diffraction analysis results of an aluminum matrix composite prepared according to Experimental Example 13.

The precursors used in Experimental Examples 13 and 14 were each prepared by using aluminum powder, copper oxide powder, titanium oxide powder, and zirconium boride powder. Referring to Table 2, it was confirmed that in all the experimental examples, alumina and titanium boride were produced at the molten metal temperature of 910° C. or less. FIG. 11 shows a microstructure of the aluminum matrix composite prepared according to Experimental Example 13, and referring to FIG. 11, it was confirmed that fine titanium boride particles (gray particles) and alumina particles (black particles) were generated in a matrix, and the generation of fine titanium carbide and alumina particles was confirmed from X-ray diffraction analysis results of FIG. 12.

Also, even in the case of Comparative Example 3, like Comparative Example 2, when the precursor was added to molten metal that has been maintained at a temperature of 930° C., and then, maintained for 10 minutes, any reaction did not occur, and thus, it was failed to obtain an aluminum matrix composite reinforced with titanium boride and alumina.

Table 3 shows a composition of a precursor used in preparing an aluminum matrix composite in which alumina and titanium carbide are dispersed as a reinforcing material and the temperature of molten metal maintained during reaction.

The precursors used in Experimental Examples 15 to 20 were prepared by mixing different amounts of titanium powder, carbon powder, aluminum powder, and copper oxide powder that acts as an active material. The precursors were completely mixed and then molded under pressure by using a press to be in the form of a pellet.

Molten aluminum used in experimental examples and comparative examples other than Experimental Example 20 was prepared by cutting a pure aluminum ingot and completely dissolving the cut pure aluminum ingot in a furnace, and then, maintained at a predetermined temperature. In this regard, the temperature of molten metal was varied from about 810° C. to 920° C. The prepared pellets were added to molten aluminum, and then, when the added pellets completely reacted and dissolved in molten metal, the resultant molten metal was stirred by using a graphite rod, and then, cast into a mold to complete the preparation of a composite.

TABLE 3

| Sample | Molten metal | Composition of pellet (wt %) CuO | Al | Ti + C | Molten metal temperature (° C.) | Reaction |
|---|---|---|---|---|---|---|
| Experimental Example 15 | pure aluminum | 7.2 | 37.5 | residual, the atomic ratio of T:C is 1:1 | 916 | Complete reaction |
| Experimental Example 16 | pure aluminum | 9.5 | 19.2 | residual, the atomic ratio of T:C is 1:1 | 815 | Complete reaction |
| Experimental Example 17 | pure aluminum | 15.4 | 26.3 | residual, the atomic ratio of T:C is 1:1 | 815 | Complete reaction |
| Experimental Example 18 | pure aluminum | 8.4 | 28.4 | residual, the atomic ratio of T:C is 1:1 | 816 | Complete reaction |
| Experimental Example 19 | pure aluminum | 3.1 | 20.6 | residual, the atomic ratio of T:C is 1:1 | 814 | Complete reaction |
| Experimental Example 20 | A6061 | 7.2 | 37.5 | residual, the atomic ratio of T:C is 1:1 | 901 | Complete reaction |
| Comparative Example 4 | pure aluminum | 0 | 12.0 | residual, the atomic ratio of T:C is 1:1 | 815 | Incomplete reaction |
| Comparative Example 5 | pure aluminum | 0 | 21.3 | residual, the atomic ratio of T:C is 1:1 | 810 | Incomplete reaction |
| Comparative Example 6 | pure aluminum | 0 | 40.4 | residual, the atomic ratio of T:C is 1:1 | 920 | Incomplete reaction |

Figure 13:
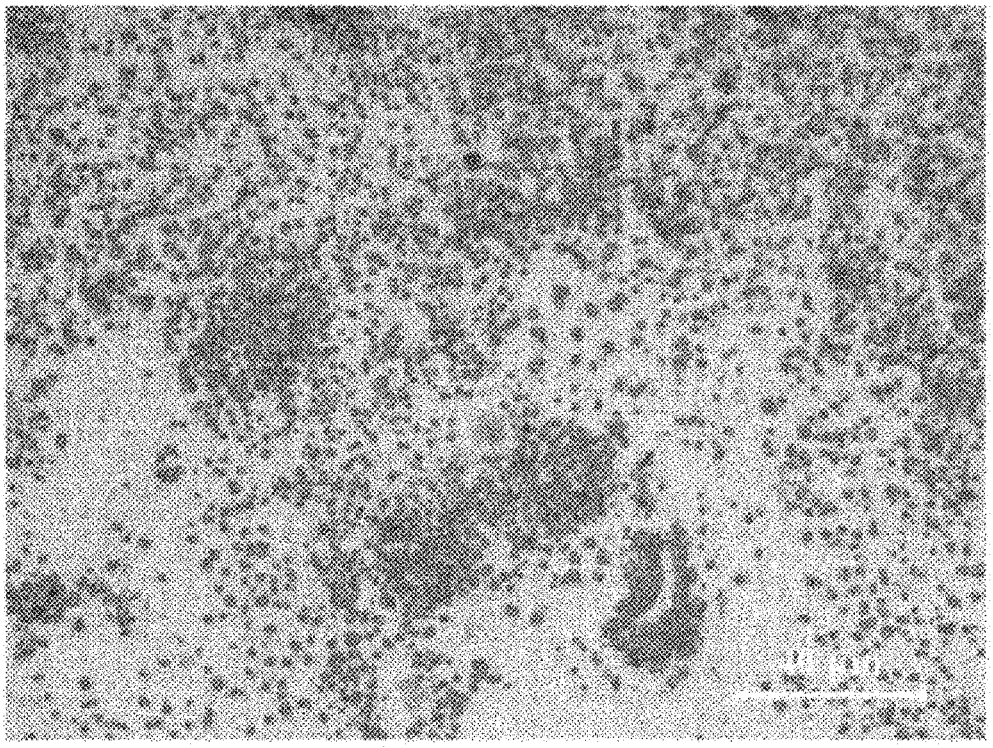
FIG. 13 shows a microstructure of an aluminum matrix composite prepared according Experimental Example 17.
Figure 14:
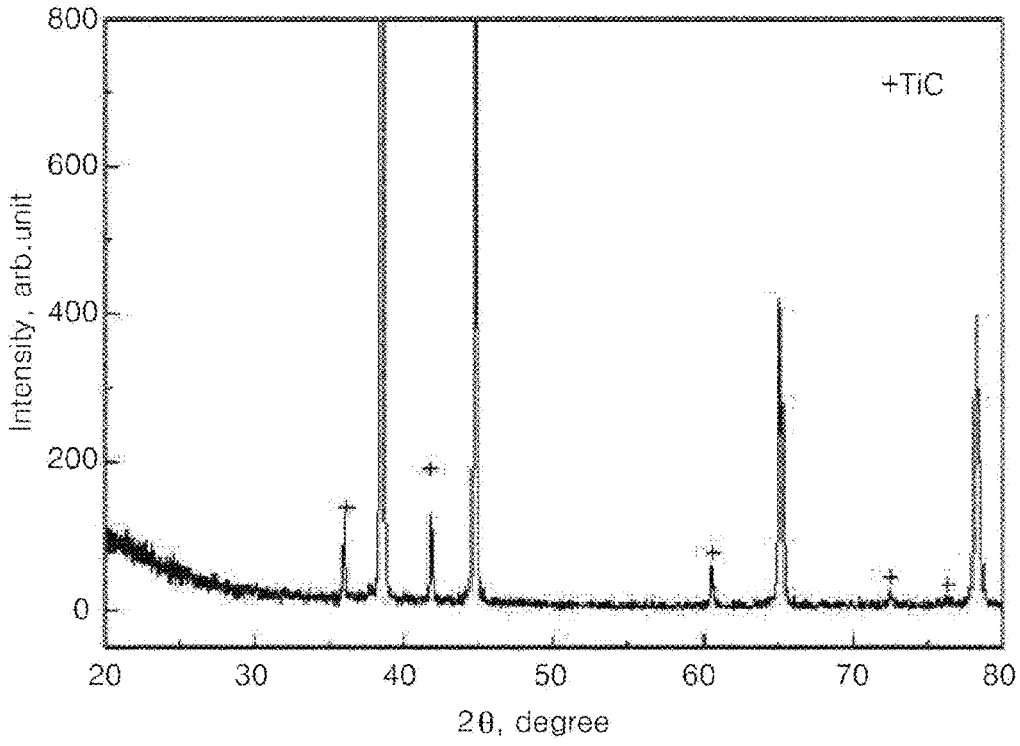
FIG. 14 shows X-ray diffraction analysis results of the aluminum matrix composite prepared according to Experimental Example 17.

Referring to Table 3, it was confirmed that in Experimental Examples 15 to 20, titanium carbide was produced at the molten metal temperature of 916° C. or less. FIG. 13 shows a microstructure of the aluminum matrix composite prepared according to Experimental Example 17, and referring to FIG. 13, it was confirmed that fine titanium carbide particles (dark gray) were generated in a matrix, and the generation of fine titanium carbide particles was confirmed from X-ray diffraction analysis results of FIG. 14.

In the case of Experimental Example 19, even when copper oxide powder was added in an amount of 3.1 wt %, the reaction completely occurred, and in the case of Experimental Example 20, A6061 alloy was used as molten aluminum to cause a complete reaction. Composites prepared according to Experimental Examples 19 and 20 each consisted of titanium carbide while $Al_3Ti$, which is an intermetallic compound, was almost not present in a microstructure.

Also, referring to Comparative Examples 4 to 6, when copper oxide powder was not used, the reaction incompletely occurred. In the case of Comparative Example 4, although aluminum was used in as a small amount as 12 wt % in molten aluminum at a temperature of 815° C., the reaction incompetently occurred.

On the other hand, in the case of Experimental Example 19 in which copper oxide was added in an amount of 3.1 wt %, which was higher than that used in Comparative Example 4, although 20.6 wt % of aluminum was added to molten aluminum at a temperature of 814° C., which was lower than that used in Comparative Example 4, the reaction completely occurred. From this result, it was confirmed that the addition of copper oxide has lead to a complete reaction for the production of titanium carbide particles at a lower molten metal temperature.

Figure 15:
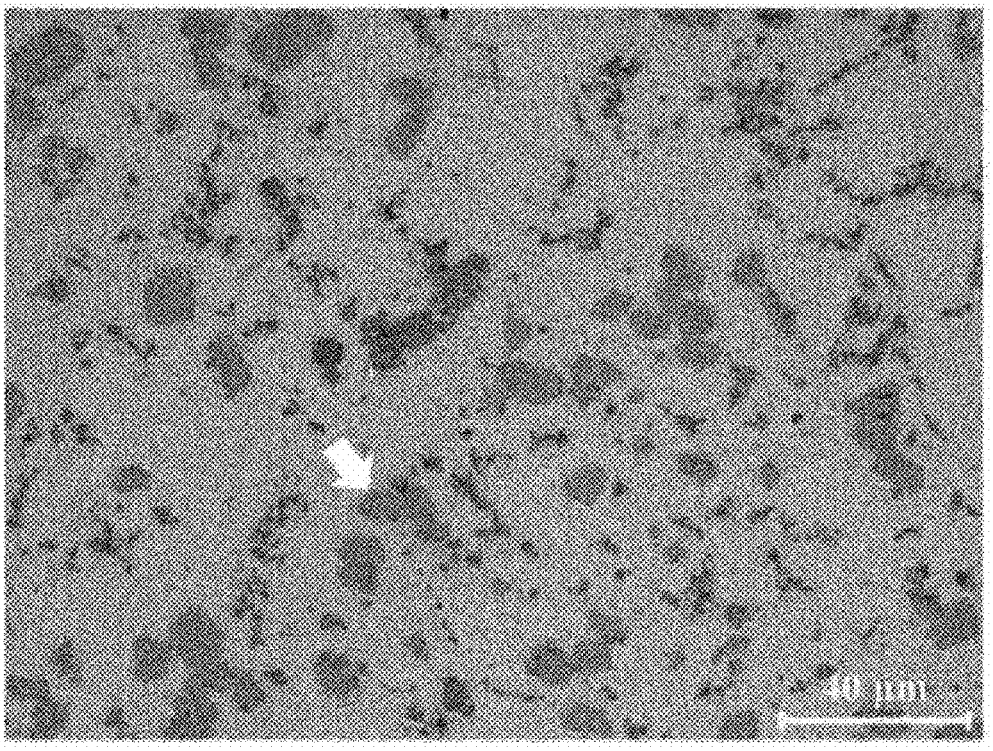
FIG. 15 shows a microstructure of an aluminum matrix composite prepared according to Comparative Example 17.
Figure 16:
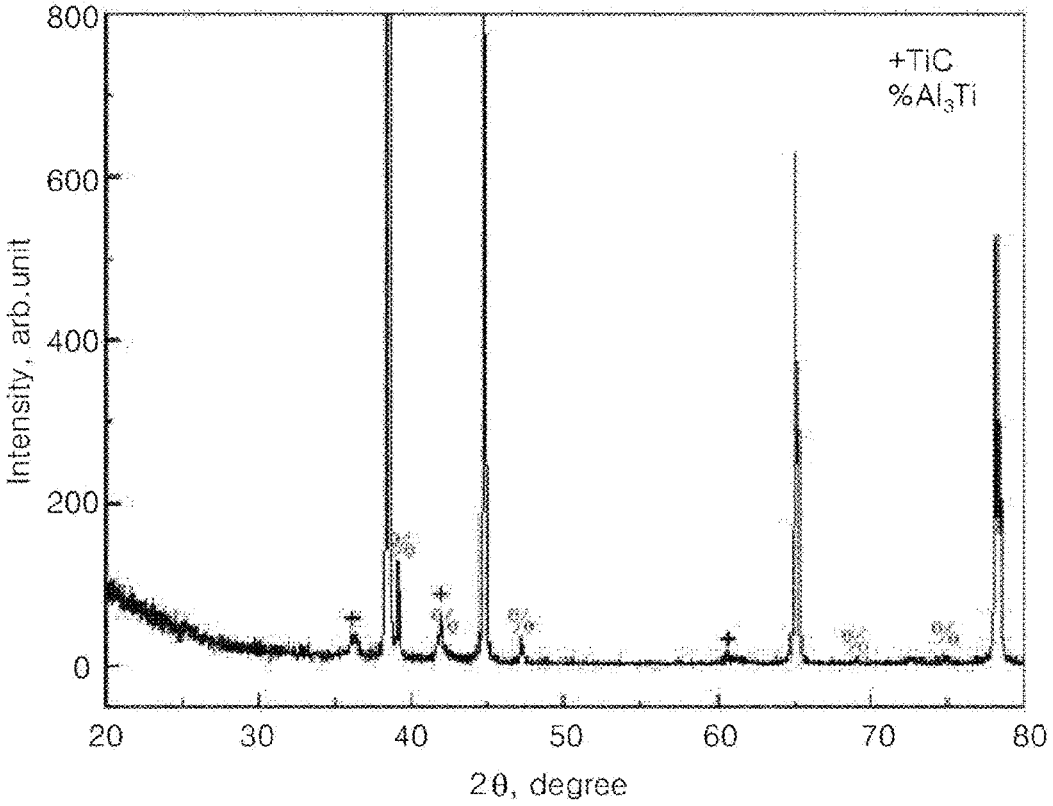
FIG. 16 shows X-ray diffraction analysis results of the aluminum matrix composite prepared according to Comparative Example 17.

In the case of Comparative Example 6, even when the temperature of molten metal was raised up to 920° C., the reaction did not occur completely. FIG. 15 shows a microstructure of the aluminum matrix composite prepared according to Comparative Example 3, and it was confirmed that in the microstructure, Al3Ti, which was a coarse intermetallic compound (white arrow), was formed in addition to the titanium carbide. This result was confirmed from X-ray diffraction results of FIG. 16.

It should be understood that the exemplary embodiments described therein should be considered in a descriptive sense only and not for purposes of limitation. Descriptions of features or aspects within each embodiment should typically be considered as being available for other similar features or aspects in other embodiments.

The invention claimed is:

1. A method of preparing an aluminum matrix composite, the method comprising:

mixing aluminum powder, a source material for titanium, and a source material for a nonmetallic element that is able to be combined with titanium to form a compound;

promoting a reaction between the aluminum powder, the source material for titanium and the source material for the nonmetallic element to prepare a precursor;

adding the precursor to molten aluminum; and casting the molten aluminum, wherein the promoting the reaction comprising:

mixing the aluminum powder, the source material for titanium and the source material for the nonmetallic element with an active material, wherein the active material includes at least one of copper oxide, cobalt oxide, manganese oxide, nickel oxide, iron oxide, vanadium oxide, chromium oxide, and tungsten oxide.

2. The method of claim 1, wherein the promoting the reaction comprising:

performing a plastic deformation on at least one of the aluminum powder, the source material for titanium, and the source material for a nonmetallic element.

3. The method of claim 1, wherein the source material for titanium includes titanium oxide powder and the source material for the nonmetallic element includes carbon powder.

4. The method of claim 1, wherein the source material for titanium includes titanium oxide powder and the source material for the nonmetallic element includes boron compound powder.

5. The method of claim 1, wherein the source material for titanium includes titanium powder and the source material for the nonmetallic element includes carbon powder.

6. The method of claim 4, wherein the boron compound powder includes boron oxide powder or zirconium boride powder.

7. The method of claim 1, wherein the active material is a material that exothermically reacts with at least one of the aluminum powder, the source material for titanium, and the source material for nonmetallic element.

8. The method of claim 1, wherein an amount of the active material is in a range of 0.1 wt % to 40 wt % based on the precursor.

9. The method of claim 1, wherein the source material for titanium includes titanium oxide powder and the active material is a material that promotes decomposition of the titanium oxide.

10. The method of claim 9, wherein the material that promotes decomposition of the titanium oxide includes alkali metal, alkali earth metal, or an oxide of these.

11. The method of claim 9, wherein the material that promotes decomposition of the titanium oxide includes barium, calcium, strontium, potassium, and an oxide of any one of these.

12. The method of claim 9, wherein the material that promotes decomposition of the titanium oxide has an amount of 5 wt % or less (greater than 0) based on the precursor.

13. The method of claim 1, further comprising performing a plastic deformation on at least one of the aluminum powder, the source material for titanium, and the source material for a nonmetallic element.

14. The method of claim 1, wherein the precursor includes a pellet prepared by molding performed by mechanical pressing to mold or a product obtained by crushing the pellet.

15. The method of claim 1, wherein the molten aluminum includes one selected from pure molten aluminum and aluminum alloy molten metal containing at least one alloy element, and wherein the alloy element includes magnesium (Mg), silicon (Si), copper (Cu), manganese (Mn), chromium (Cr), zinc (Zn), nickel (Ni), iron (Fe), tin (Sn), or lithium (Li).

* * * * *